United States Patent [19]

Negri

[11] Patent Number: 5,016,449

[45] Date of Patent: May 21, 1991

[54] METHOD OF PRODUCING QUALITY HOSIERY BY CHANGING STITCH LENGTH IN CIRCULAR KNITTING MACHINES AND A DEVICE FOR ITS IMPLEMENTATION

[75] Inventor: Ettore Negri, Florence, Italy

[73] Assignee: Savio, S.p.A., Pordenone, Italy

[21] Appl. No.: 475,809

[22] Filed: Feb. 6, 1990

[30] Foreign Application Priority Data

Feb. 10, 1989 [IT] Italy ..... 19406 A/89

[51] Int. Cl.[5] ..... D04B 9/46

[52] U.S. Cl. ..... 66/54

[58] Field of Search ..... 66/54, 149 R

[56] References Cited

U.S. PATENT DOCUMENTS

| | | | |
|---|---|---|---|
| 3,785,174 | 1/1974 | Mishcon | 66/54 X |
| 4,492,097 | 1/1985 | Ferraris | 66/54 X |
| 4,665,720 | 5/1987 | Beconcini et al. | 66/149 R X |
| 4,712,390 | 12/1987 | Lomati | 66/54 |
| 4,879,884 | 11/1989 | Bertagnoli | 66/54 |
| 4,945,734 | 8/1990 | Maruyama | 66/149 R |

FOREIGN PATENT DOCUMENTS

| | | | |
|---|---|---|---|
| 0300946 | 1/1989 | European Pat. Off. . | |
| 1257346 | 12/1967 | Fed. Rep. of Germany . | |
| 1945000 | 4/1970 | Fed. Rep. of Germany . | |
| 2631223 | 1/1978 | Fed. Rep. of Germany | 66/149 R |
| 1377602 | 10/1963 | France . | |
| 3075156 | 4/1988 | Japan | 66/149 R |
| 2192903 | 1/1988 | United Kingdom . | |
| 2193230 | 2/1988 | United Kingdom . | |

*Primary Examiner*—Werner H. Schroeder
*Assistant Examiner*—John J. Calvert
*Attorney, Agent, or Firm*—Hedman, Gibson, Costigan & Hoare

[57] ABSTRACT

This invention is directed to an improved method for producing quality hosiery in circular knitting machines by changing the stitch length. The density of the knitted hose is regulated by measuring the axial advancement of a tensioning device. This produces hose portion by portion and consequently varies the level difference between the sinker knock-down plane and the minimum level reached by the active needles.

13 Claims, 2 Drawing Sheets

METHOD OF PRODUCING QUALITY HOSIERY BY CHANGING STITCH LENGTH IN CIRCULAR KNITTING MACHINES AND A DEVICE FOR ITS IMPLEMENTATION

FIELD OF THE INVENTION

This invention relates to a method for producing knitted hose by changing the stitch length in a circular knitting machine. The density of the knitted hose is regulated with precision as the hose production proceeds through consecutive courses.

BACKGROUND OF THE INVENTION

More particularly, with reference to the production of quality hosiery articles, the invention relates to a method which enables the length of the stitch loops (and thus the extensibility of the article) to be accurately adjusted so that it adheres with greater comfort and better appearance on the leg of the wearer. The human leg is typically shaped with a transverse dimension varying gradually along its length passing through the ankle, calf, knee and thigh. The extensibility of the knitted hose must be regulated correspondingly.

The article is made extensible, generally, by varying the stitch density, i.e. the length of the stitch loops which are formed course by course by the interaction of the needles and sinkers.

To understand the technical problems involved, it is necessary to consider the operation of a circular knitting machine.

FIG. 1 shows a simplified scheme of a double cylinder circular knitting machine. Although reference will be made thereto, it is to be understood that the present invention is also advantageously applicable to a single-cylinder circular knitting machine.

The upper and lower cylinders are indicated diagrammatically by numerals 1 and 2. The knitted hose is formed in the zone indicated by numeral 3 by the needles 4 which cooperate with the sinkers 5.

The needles 4 are arranged on the outer surface of the cylinders 1 and 2 in suitable slide grooves along their generating lines. The sinkers 5 are arranged on the end of the cylinder 2.

The knitted hose is formed along the outer periphery of the cylinder which supports and guides the needles 4 in their rotary and reciprocating movement. This is in cooperation with the sinkers 5 and the yarn feeds. The yarn feeds are not shown in the figure.

In the device illustrated in FIG. 1, for reason of simplicity, the machine is shown during the production of a portion of plain knitted hose. In this example, only the needles of the lower cylinder or bed act together with the relative sinkers. During this manufacture, the needles of the upper bed are transferred into the lower bed of the machine. If other types of stitches are produced, for example, a rib stitch, some needles are transferred by the machine from the lower bed to the upper bed.

The length of the stitch loop is determined by the difference in level between the plane in which the sinkers 5 retain the yarn F which is deposited on them (known as the knock-over plane), and the plane which the needle 4 is lowered to its minimum level. This is accomplished after the needle 4 is raised to its maximum level while retaining the yarn in its upper hook. This maximum level is not shown in the figure.

The loop length, generally, is determined by one of two alternative methods. In one method, the level of the knock-over plane is kept fixed (in accordance with the double-direction arrow), by positioning it at a higher or lower level by the cam 6. The cam 6 lowers the needle to the required level by means of its lower contour which engages the butt 7 of the needle 4. In an alternative method, the axial position of the cam 6 is kept fixed and the level of the knock-over plane is varied by raising the circular ring 9 which supports the sinkers 5 relative to the cylinder.

For correct clearance of the production of the knitted hose and for the correct formation of the new knitwork courses, the hose is removed from the zone 3 by making it penetrate into the cylinder 1. During this step, the hose must be kept under tension.

This tension must be both constant and substantial, particularly for knitted fabrics of certain consistencies.

Generally, tensioning members which axially move inside the circular machine cylinders are used.

By way of example, devices of this type are described in U.S. Pat. No. 4516410 in the name of Lonati S.p.A. or in the U.S. Pat No. 4665720 in the name of Officine Savio, S.p.A. FIG. 1 shows diagrammatically the tensioning device 8 of said U.S. Pat.

Said device exerts a substantially constant tension and withdraws the gradually produced hose by drawing it upwards from the zone 3 in which the knitwork is formed course by course.

It has been found that the length of the produced stitch loops does not correspond unequivocally to the difference in level between the knock-over plane which is, in turn determined by the axial position of the sinkers 5, and the plane representing the minimum level reached by the hook of the needle 4 by the action of the lowering cam 6. In this respect, after the needle 4 has been raised to its maximum level and has grasped the yarn from the feed, the needle is lowered to its minimum level in order to form the stitch. This is accomplished by dragging the yarn from an overlying bobbin. During this procedure, the yarn itself offers a certain amount of resistance. This resistance is due to the friction involved in the various directional changes of the yarn between the needle 4 and the feed bobbin and also due to the unwinding of the yarn from the bobbin itself. This can be of considerable and variable size, and such resistance varies considerably.

This resistance to the release of the feed yarn results in a sometimes considerable elongation of the yarn and even in the withdrawal of yarn from previously formed loops. This consequently shortens them.

Thus, the stitch loops formed from a taut yarn has a length in their rest state which is less than that desired, that is, once they are released and cleared from the needles. Therefore, the knitted hose which is produced in this manner does not have the required density nor the consequent extensibility.

However, even if it is desired to take into account the amount of tension of the yarn during loop formation by oversizing to a certain extent the level difference, (i.e. the length of the active needle stroke) in order to compensate for the release of tension, this method is unsatisfactory because the yarn tension varies during its working.

To obviate this drawback it has been proposed in GB patent 2193230 of Elitex to measure the speed at which the yarn is actually transferred by the feed and to correlate it in unit time with the yarn length which would have had to be knitted along the path between the needles and sinkers. This is accomplished on the basis of their predetermined level difference. If any positive or negative deviation from this value is found, the level difference is correspondingly varied so that the formed loop is of the correct length.

This expedient, however, only partly solves the technical problem because the measurement of the speed, (i.e. the length of yarn transferred in unit time which itself is related to the yarn length used to form the knitwork courses), is effected on the yarn under tension, that is, while the yarn is still affected by the very uncertainties which cause the variation in the effective length of the stitch loops.

Further causes of the inaccuracy of this measurement are that the resistance offered to the unwinding of the yarn is not constant, the yarn itself has an elongation/-tension characteristic which is not a straight line, and the free taut length of the yarn varies periodically from a minimum to a maximum depending on the point from which it is withdrawn from the bobbin.

SUMMARY OF THE INVENTION

In contrast, the present invention is based on determining the effective length of the stitch loops once they have been released from the needles. In this respect it has been found that the variation in the length of the loops of the produced knitted hose is directly related to the movement of the tensioning device 8. The tensioning device 8 is operated with a constant tensioning force. This constant tensioning force becomes distributed over the entire circumference of the produced hose. The axial movement of the device 8 is faster in the case of longer loops and slower in the case of shorter loops. This is in proportion to the effective increase or decrease in the length of the loops when the loops are in their rest state. The present invention comprises a method for producing knitted hose of variable density. The stitch loops have a variable length. This variable length is regulated with precision according to the length of the hose itself. The monitoring of the actual length of the produced stitch loops is effected by comparing the variation in the axial velocity of the tensioning device 8, i.e. its movement per unit of time, with the variation in the required length of the loop. This is accomplished portion by portion, i.e. with the desired variation in this axial velocity.

More specifically, the advancement of the mobile device 8 is determined for a predetermined number of produced courses of knitwork. It is then compared with a reference value which represents the desired advancement per course.

If this comparison of the axial movement of the tensioning device 8 shows that it is less than required, the distance between the plane of deposition of the yarn F on the sinkers 5, (i.e. the knock-down plane), and the plane in which the needles 4 are at their minimum level (after the yarn has been grasped as determined by the axial position of the cam 6), is then correspondingly increased. This variation can be effected either by raising the plane in which the sinkers 5 lie by axially raising their support 9, or by lowering the cam 6.

If instead the axial movement of the tensioning device 8 is shown to be greater than required, the opposite action is taken. The distance between the knock-down plane of the sinkers 5 and the minimum level plane of the active needles 4 is reduced.

The tensioning device comprises a piston which is subjected to constant fluid pressure.

Thus, the present invention is based on the recognition that the variation in the length of the loops of the produced knitting fabric is directly related to the movement of the tensioning device which engages the fabric during knitting with constant tensioning force, that becomes distributed over the entire circumference of the knitted tubular fabric.

Monitoring the axial movement of the tensioning device which provides constant tension (in that it is itself subjected to a constant fluid pressure) and detecting whether it moves faster or slower than it should during knitting, represents an indication of the actual length of the loops being formed. This therefore provides an indication whether or not the required values of loop lengths are effectively produced in the course of knitting.

In summary, the present invention therefore consists in:

(1) determining (measuring) the amount of axial movement of a tensioning device operated by constant pressure or a device applying a constant tensioning force onto the fabric being knitted;

(2) comparing the detected rate of movement with a predetermined rate of movement corresponding to that effectively experienced for obtaining the desired loop lengths on the fabric; and (3) correcting the level difference between the knocking-over plane of the sinkers and the bottom level of the stitch forming needles controlled by the stitch cams, when the actually detected rate of movement differs from that which has been predetermined for that fabric portion which is just being knitted.

DETAILED DESCRIPTION OF THE PRESENT INVENTION

Figure 1:
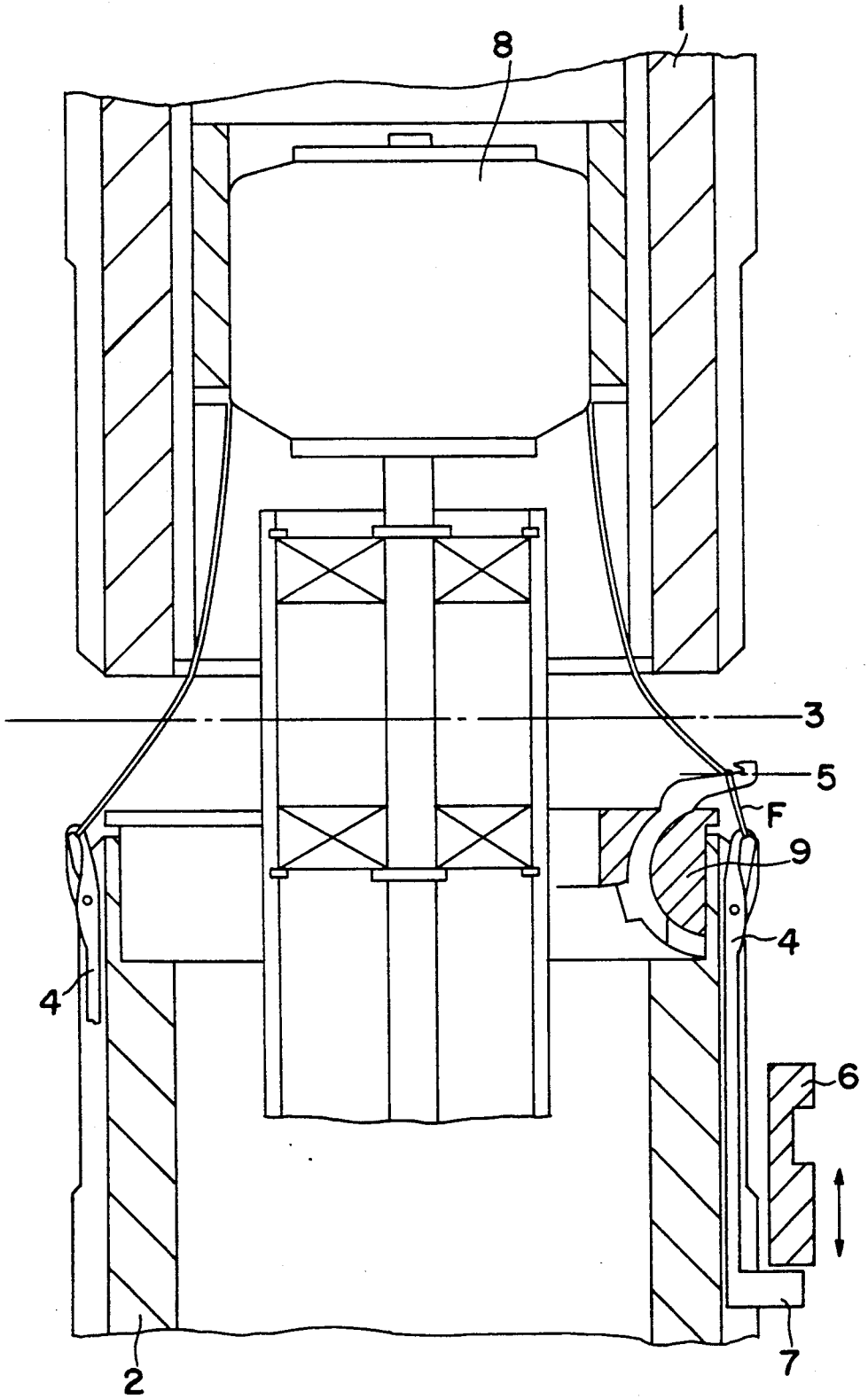
FIG.1 PRIOR ART
Figure 2:
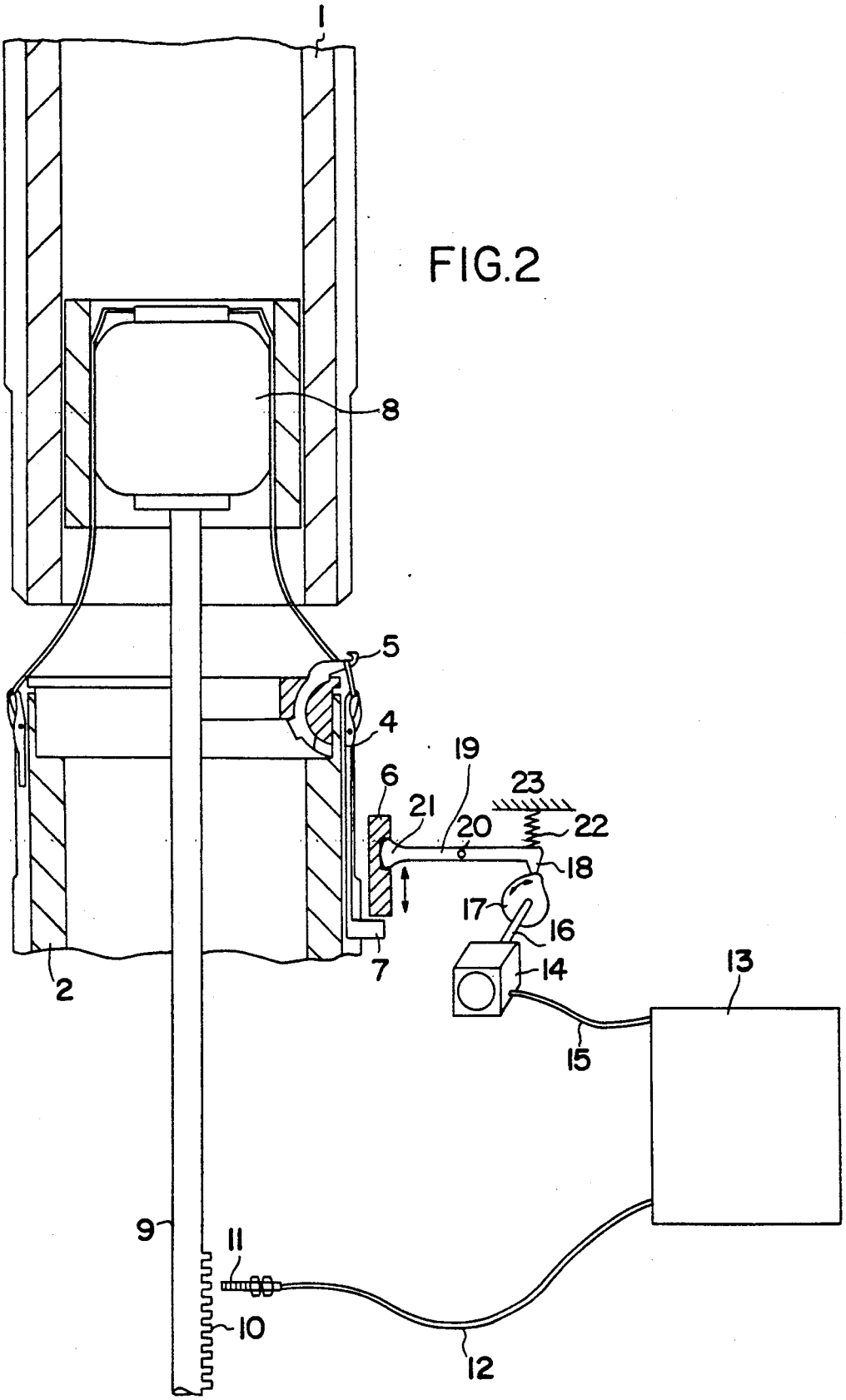

FIG. 2 shows by way of non-limiting example a typical embodiment of the method according to the invention. A device is incorporated for regulating the length of the stitch loops by varying the level of the position of the cam 6.

On the axially mobile guide rod 9 of the tensioning device 8 there is disposed a series of reference markers 10. These reference markers 10 are sensed by a fixed sensor 11, for example a proximity sensor.

As the rod 9 moves axially, the markers 10 pass by the sensor 11. The sensor 11 senses their passage.

The sensor 11 is connected by a connection 12 to a control unit 13. Control unit 13 is a type of microprocessor to which the pulses generated by the axial advancement of the rod 9 are transmitted. The pulses are analyzed with predetermined scanning referred to the knitwork courses produced or to the cylinder revolutions, for example every five cylinder revolutions.

The commencement of scanning can be advantageously fixed as the commencement of production of each new knitted hose. It can alternatively be fixed as the commencement of that portion of hose through which the density is to be regulated.

The unit 13 can be advantageously integrated into the control electronics of the circular knitting machine. The unit 13 also contains a series of discrete successive reference values for each portion of hose produced. This corresponds, for example, to every five revolutions of the cylinder. It then compares them with the values obtained by the sensor.

If the comparison shows a deficiency, i.e. if the rod 9 has moved less that it should, the loops must be lengthened. Therefore, the cam 6 which is at too high a level is correspondingly lowered. If the comparison shows an excess, the loops must be shortened and therefore the cam 6 is raised.

The unit 13 controls the positioning of the cam 6 on the basis of the comparison between the values obtained by the sensor and the reference values.

For this purpose the unit 13 also contains the control electronics for the stepping motor 14 and operates it via the connection 15. The stepping motor 14 undergoes controlled clockwise or anticlockwise rotations to rotate the shaft 16. At the other end of the shaft 16 is a rotary cam 17 having a variable radius. The cam 17 engages the point 18 of the lever 19. This is then pivoted at 20 and engages with its other end 21 of the cam 6 for lowering the needles 4.

An elastic element 22 which interacts with a fixed part 23 ensures constant contact between the point 18 and the contour of the cam 17.

The clockwise or anticlockwise rotations of the stepping motor 14 and the cam 17 result in either lowering or raising the cam 6 and therefore varies the level difference between the knock-down plane of the sinkers 5 and the minimum lowered needle level. This determines the length of the stitch loops.

The method and device of the invention enable stitch loops of the required length to be obtained through every portion of the produced knitted hose. This is accomplished independently of the state of tension of the yarn during its feed, and independently of the other described causes of disturbance.

In order to materially perform the present invention, the following steps are carried out.

The values of the desired widths of the fabric throughout its length are inserted into the machine memory (electronic control unit) and a test stocking is produced. A device according to the invention modifies, during the knitting operation, the level difference between the knocking-over plane of the sinkers and the minimum level of the needles (i.e. the position of the stitch cams) so as to obtain a progress of movement of the tensioning piston corresponding to the preestablished fabric width (which depends from the length of the loops). The actual progress of the movement of the tensioner is now memorized at each course of knitting or at a given number of subsequent courses.

The finished stocking is examined and it is ascertained whether it corresponds at any point to the desired width. If there is any difference, the amount of this difference is determined and a corrected value is introduced into the memory in place of that previously memorized.

A new stocking is manufactured on the basis of the new values, to which, clearly, new values of progress of movement of the tensioner correspond. Once the produced stocking completely corresponds to the desired stocking, the control unit contains the sequence of values of rate of advancement of the tensioner. By comparing, during knitting of each subsequent stocking, the values detected by the sensor 11 with those memorized, the machine automatically provides the required adjustment of the stitch cams if a difference between the detected and the memorized values occur.

Should there be a variation in the humidity which would cause a variation in the tension of the thread fed to the machine or should there be a difference in quality or nature of the thread as the feeding thereof to the machine proceeds, the machine would adapt itself to the new situation and promptly correct the stitch length for always producing fabrics having the desired stitch length along the fabric.

The resultant hosiery is produced exactly to the required size and shape.

I claim:

1. A method of producing knitted hosiery having regulated stitch loops in circular knitting machines wherein the knitting machines have needles, sinkers, a tensioning device, and a cam, and wherein movement of the needles is controlled by the cam; the method comprising:

(a) determining the amount of axial movement of the tensioning device, wherein the tensioning device draws the hosiery and applies a constant force thereto during knitting;

(b) comparing said determined amount of axial movement of the tensioning device with a predetermined amount of axial movement wherein said predetermined amount of axial movement corresponds to a desired length of the stitch loops in the hosiery; and (c) correcting the relative difference in level between the sinkers and the needles by moving the cam when said amount of axial movement of the tensioning device differs from said predetermined amount of axial movement so that the length of the stitch loops are consequently regulated.

2. The method of claim 1, wherein said determining step comprises measuring said amount of axial movement of the tensioning device and comparing said measured amount of axial movement of the tensioning device with a series of desired amounts of axial movement.

3. The method of claim 2, wherein said measured amount and said series of desired amounts of axial movement of the tensioning device is related to a number of revolutions of the circular knitting machine starting from the commencement of production of a new knitted hose.

4. The method of claim 2, wherein said measured amount and said series o desired amounts of axial movement of the tensioning device is related to a number of courses on the hosiery.

5. The method of claim 2, wherein said measured amount and said series of desired amounts of axial movement of the tensioning device is related to a number of revolutions of the knitting machine starting from the movement that the stitch loops are regulated.

6. The method of claims 1, 2, 3, 4 or 5 further comprising lowering the cam away from the sinkers when the amount of axial movement of the tensioning device is less than desired and raising the cam towards the sinkers when the amount of axial movement of the tensioning device is greater than desired.

7. A device for producing knitted hosiery having regulated stitch loops in circular knitting machines, wherein the knitting machines have needles, sinkers, a tensioning device, and a cam, and wherein movement of the needles is controlled by the cam; comprising:

(a) determining means connected to the device for determining the amount of axial movement of the tensioning device, wherein the tensioning device is for drawing the hosiery and for applying a constant force thereto during knitting;

(b) comparing means operatively connected to said determining means for comparing said determining amount of axial movement of the tensioning device with a predetermined amount of axial movement, wherein said predetermined amount of axial movement corresponds to a desired length of the stitch loops in the hosiery; and (c) correction means operatively connected to said comparing means for correcting the relative difference in level between the sinkers and the needles as determined by said comparison means when said amount of axial movement of the tensioning device differs from said predetermined amount of axial movement so that the length of the stitch loops are consequently regulated.

8. The device of claim 7, wherein the tensioning device comprises a series of reference markers on the tensioning device and the device further comprises:

(a) a sensor connected to the device for sensing movement of said series of reference markers when the tensioning device axially moves and for generating a signal; and (b) a microprocessor connected to said sensor for receiving said signal from said sensor, for comparing the axial movement of the tensioning device with said predetermined amount of axial movement, and for controlling and rotating the cam to adjust the relative difference in level between the sinkers and the needles so that the length of the stitch loops are consequently regulated.

9. A device for producing knitted hosiery having regulated stitch loops in circular knitting machines, wherein the knitting machines have needles, sinkers, a tensioning device, and a cam, and wherein movement of the needles is controlled by the cam; comprising:

(a) a series of reference markers on the tensioning device wherein the tensioning device is for drawing the hosiery and for applying a constant force thereto during knitting;

(b) determining means connected to the device for determining the amount of axial movement of the tensioning device, wherein said determining means comprises a sensor connected to the device for sensing movement of said series of reference markers when the tensioning device axially moves and for generating a signal;

(c) comparing means operatively connected to said determining means for receiving said signal from said sensor and for comparing said determining amount of axial movement of the tensioning device with a predetermined amount of axial movement, wherein said predetermined amount of axial movement corresponds to a desired length of the stitch loops in the hosiery, and wherein said comparing means comprises a microprocessor; and (d) correction means operatively connected to said comparing means for correcting the relative difference in level between the sinkers and the needles as determined by said comparison means when said amount of axial movement of the tensioning device differs from said predetermined amount of axial movement and wherein said correction means is operatively connected to the cam for controlling and rotating the cam to adjust the relative difference in level between the sinkers and the needles so that the length of the stitch loops are consequently regulated.

10. The device of claim 8 further comprising a stepping motor operatively connected to the cam and controlled by said microprocessor for controlling said rotation of the cam and a lever system operatively connecting the cam to the needles so that the difference in level between the needles and the sinkers can be controlled.

11. The device of claim 9 further comprising a stepping motor operatively connected to the cam and controlled by said microprocessor for controlling said rotation of the cam and a lever system operatively connecting the cam to the needles so that the difference in level between the needles and the sinkers can be controlled.

12. The device of claim 10 wherein said stepping motor rotates either clockwise or counter clockwise for respectively raising or lowering the cam.

13. The device of claim 11 wherein said stepping motor rotates either clockwise or counter clockwise for respectively raising or lowering the cam.

* * * * *